US009282827B1

(12) United States Patent
Lu

(10) Patent No.: US 9,282,827 B1
(45) Date of Patent: Mar. 15, 2016

(54) LIFTING STAND FOR ADJUSTING HEADREST

(71) Applicant: Dongguan Weihong Hardware and Plastic Products Co., Ltd., Dongguan (CN)

(72) Inventor: Wei Lu, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 14/609,923

(22) Filed: Jan. 30, 2015

(51) Int. Cl.
*F16M 13/00* (2006.01)
*A47C 20/04* (2006.01)
*F16M 13/02* (2006.01)

(52) U.S. Cl.
CPC ..... *A47C 20/041* (2013.01); *F16M 13/022* (2013.01)

(58) Field of Classification Search
CPC .... A47C 20/04; A47C 20/041; A47C 20/042; A47C 20/043; A47C 20/046; A47C 20/047; A47C 20/048; A47C 20/08; A47C 7/36; A47C 7/38; A47C 16/00; A47C 20/00; F16M 13/022; A61G 15/125
USPC ..... 248/584, 588, 118, 118.3, 421, 595, 248/591, 564; 297/61, 391, 408, 410, 297/344.15–344.17; 5/53.2, 622
See application file for complete search history.

(56) References Cited

U.S. PATENT DOCUMENTS 3,596,982 A * 8/1971 Grams ..... A61G 15/02 297/330
6,155,642 A * 12/2000 Kawakami ..... A47C 1/06 248/421

* cited by examiner

*Primary Examiner* — Christopher Garft
(74) *Attorney, Agent, or Firm* — Shimokaji IP

(57) ABSTRACT

A lifting stand for adjusting headrest includes a linear drive device and a connecting link assembly. The connecting link assembly includes a first fastener, a second fastener, a first connecting link, a second connecting link, a third connecting link, and a fourth connecting link. The first and second links are pivotally connected to the first fastener, the other end of the first connecting link is pivotally connected to the third connecting link which is connected to the second fastener, and the second connecting link is pivotally connected to the fourth connecting link which is connected to the second fastener and the third connecting link. The linear drive device is connected to the first fastener, and its output end is connected to the third connecting link. The lifting stand can automatically adjust the position of the headrest and keep a nice appearance for sofas.

10 Claims, 4 Drawing Sheets

LIFTING STAND FOR ADJUSTING HEADREST

RELATED APPLICATIONS

This application claims the benefit of priority to Chinese Patent Application No. 201420867174.3 filed in Dec. 30, 2014, which is hereby incorporated by reference in its entirety.

FIELD OF THE INVENTION

The present invention relates to a field of furniture parts, more particularly to a lifting stand for automatically adjusting a tilting angle of a sofa headrest.

BACKGROUND OF THE INVENTION

Commonly, angles of a headrest of a sofa can be adjusted to meet the requirement of the customers. One of the achievement manners is to set a hinge connected with the headrest in the sofa. When customers needs to change the angle of the headrest, if only the headrest is pulled which causes the headrest and one end of the hinge pivoted with a certain angle, and then the headrest can be located in another using position and subsequently will be locked by the hinge. As such, the customer can adjust different using positions according to his actual requirement to obtain a comfortable feeling. However, this adjusting manner must require a manual operation to pull the headrest, which brings an inconvenient operation.

In addition, due to the limitations of the conventional hinge structure and its install position in the sofa, when the headrest is stood relatively to the sofa, a part of the hinge will be exposed from a connection position between the headrest and the sofa body, which weakens the appearance of the sofa.

Thus it's necessary to provide an automatic lifting stand for automatically adjusting the position of the headrest for sofas, and keeping a nice appearance for sofas.

SUMMARY OF THE INVENTION

One objective of the present invention is to provide an automatic lifting stand for automatically adjusting the position of the headrest for sofas and keeping a nice appearance for sofas.

To achieve the above objective, a lifting stand for adjusting headrest of the present invention, includes a linear drive device and at least one connecting link assembly. The connecting link assembly includes a first fastener, a second fastener, a first connecting link, a second connecting link, a third connecting link, and a fourth connecting link. One end of the first connecting link and one end of the second connecting link are pivotally connected to the first fastener respectively and arranged at intervals, the other end of the first connecting link is pivotally connected to one end of the third connecting link, the other end of the third connecting link is pivotally connected to the second fastener, the other end of the second connecting link is pivotally connected to one end of the fourth connecting link, the other end of the fourth connecting link is pivotally connected to the second fastener and arranged at intervals with the other end of the third connecting link, the second connecting link and the third connecting link are pivotally connected together with a pivot configured between the two ends of the second connecting link and between the two ends of the third connecting link as well. The linear drive device having an output end that is capable of linearly sliding is connected to the first fastener, with the output end connected to the third connecting link; the third connecting link and the fourth connecting link are folded relatively to the first fastener while the output end is drawn back, and the third connecting link and the fourth connecting link are unfolded relatively to the first fastener while the output end is protruded.

In comparison with the prior art, the linear drive device is configured in the lifting stand of the present invention. After the first fastener is fixed on the sofa body, and the second fastener is fixed on the headrest, the headrest adjustment is implemented by the lifting stand. The linear drive device is started to protrude its output end, which actuates the third connecting links and subsequently actuates the fourth connecting link to unfold relatively to the first fastener, so as to push the second fastener, thereby the sofa headrest connected with the second fastener will be driven to the different angle to achieve the position adjustment. The adjustment process is implemented automatically as long as the linear drive device is started and then stopped in a certain position, without manual operation to turn the headrest. Furthermore, because of the compact pivotal connections among the connecting link assemblies, the lifting stand will not expose on the connection position between the sofa body and the headrest, which keeps a nice appearance for the sofa.

Preferably, the first fastener is configured vertically, the first and the second connecting links are extended towards the same side of the first fastener, the second connecting link is pivotally connected to an upper of the first fastener, a pivot between the first fastener and the first connecting link is configured below a pivot between the first fastener and the second connecting link, the third connecting link is pivotally connected to one end of the second fastener, and a distance from a pivot between the second fastener and the fourth connecting link to the other end of the second fastener is shorter than that from a pivot between the second fastener and the third connecting link to the other end of the second fastener. As such, the second fattener will be turned over during the protruding operation of the output end, so as to change the position of the headrest.

As an embodiment, the end of the second fastener where the third connecting link is connected is provided with a connecting portion that is bended towards the other end of the second fastener, and the fourth connecting link is pivotally connected to the connecting portion. As such, a distance from a pivot between the second fastener and the fourth connecting link to the other end of the second fastener is shorter than that from a pivot between the second fastener and the third connecting link to the other end of the second fastener, and the moment applied to the second fastener is increased to facilitate the turning-over of the second fastener.

Preferably, the linear drive device has a lower end connected to the first fastener, and an upper end tilted to a side where the first and the second connecting links are extended, and the output end has a sliding direction tilted relatively to a vertical direction. By this arrangement, the links can be folded or unfolded smoothly.

Preferably, the third and the fourth connecting links are linear linking members, and the first and the second connecting links are bended arc linking members.

As another embodiment, two connecting link assemblies are included, and the linear drive device is configured between the two connecting link assemblies. As such, the connection, the support strength between the connecting link assemblies and the sofa and headrest are enhanced to maintain a stable operation.

Preferably, the lifting stand further includes a fixed pole and a driving pole, wherein two ends of the fixed pole are fixed on the first fasteners of the two connecting link assemblies respectively, two ends of the driving pole are fixed on the third connecting links of the two connecting link assemblies respectively, the linear drive device is pivotally connected to the fixed pole, and the output end thereof is pivotally connected to the driving pole.

Preferably, two pivoting arms are protruded and formed on the driving pole, which are positioned at two sides of the output end and pivotally connected to the output end.

More preferably, a connecting piece is formed on two ends of the driving pole respectively, and the connecting piece has one end fixed on the driving pole and the other end fixed on the third connecting link.

Preferably, the linear drive device comprises a linear motor.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
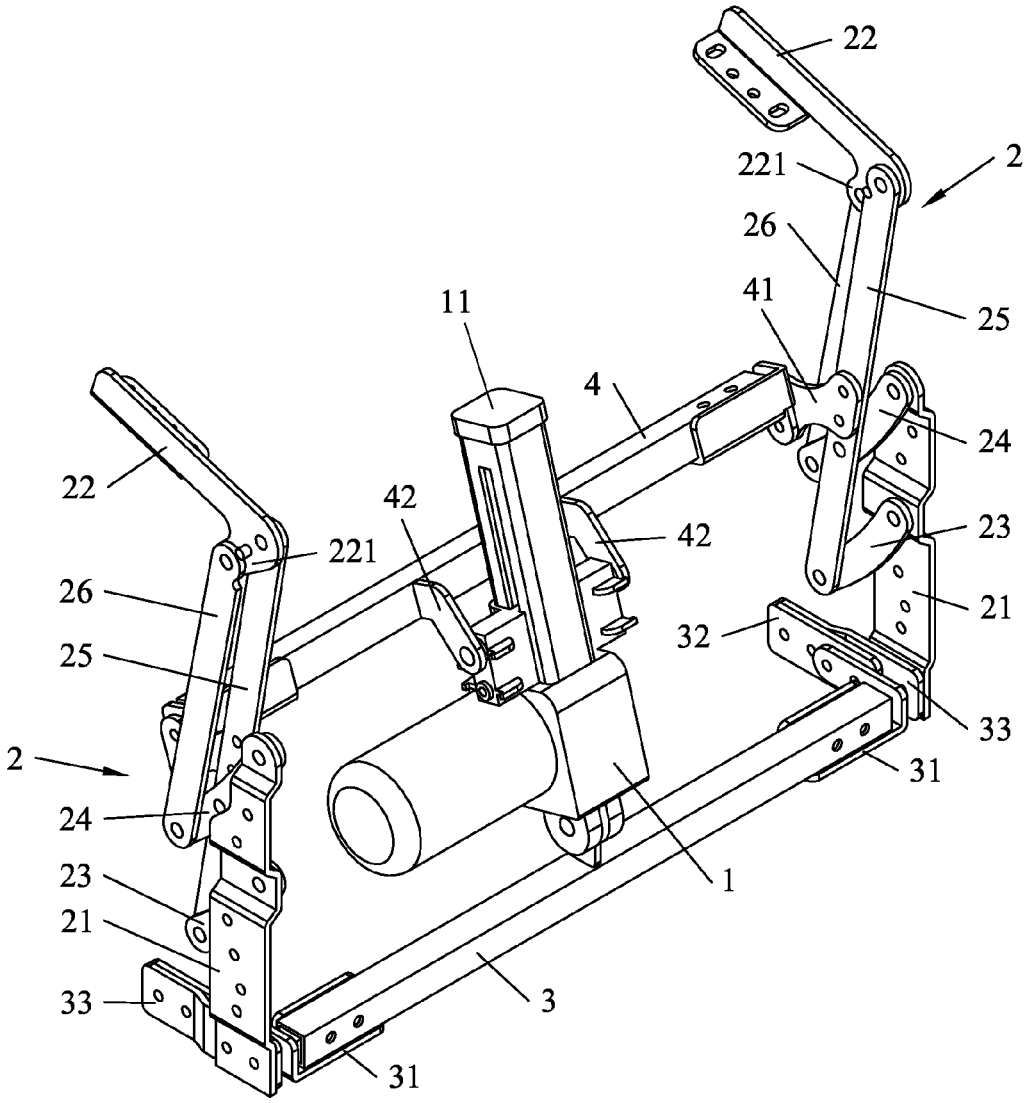
FIG. 1 is a perspective view of a lifting stand according to one embodiment of the present invention.
Figure 2:
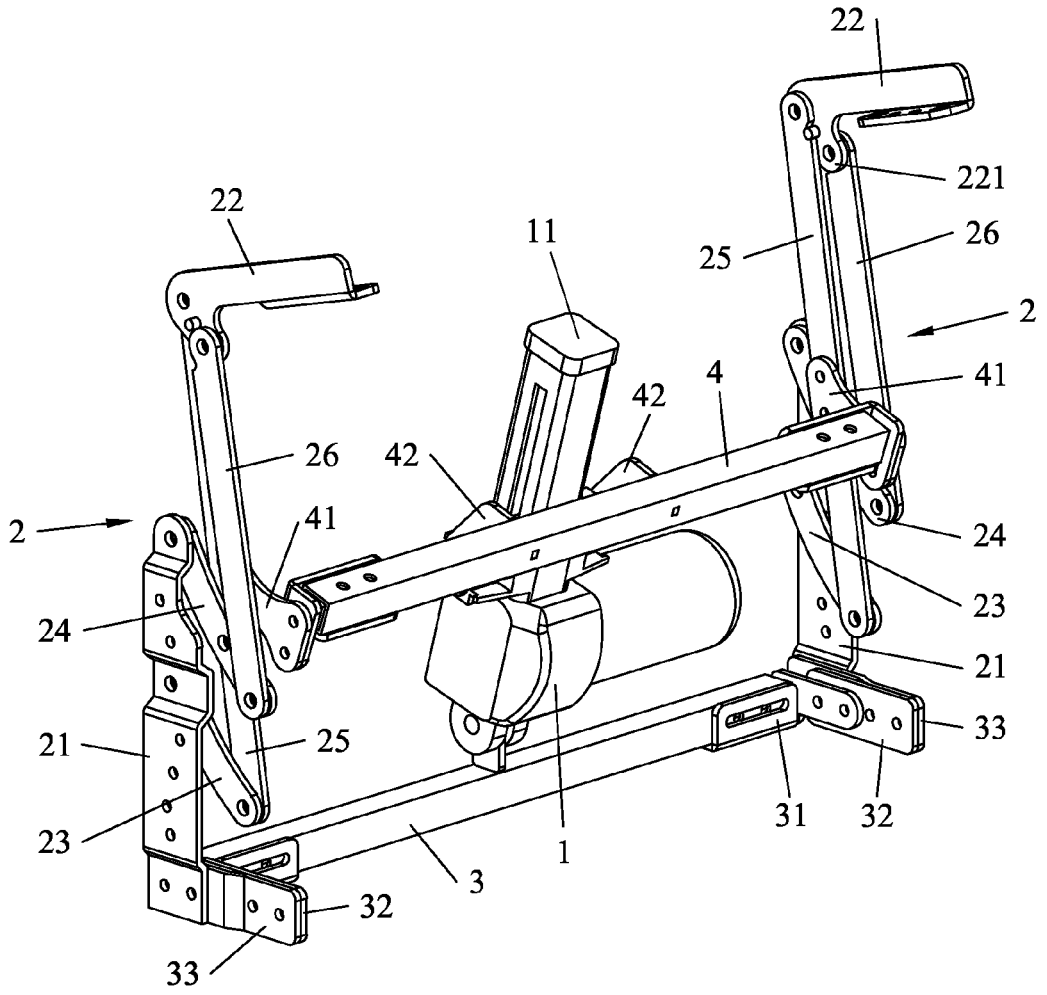
FIG. 2 is another perspective view of the lifting stand according to one embodiment of the present invention.
Figure 3:
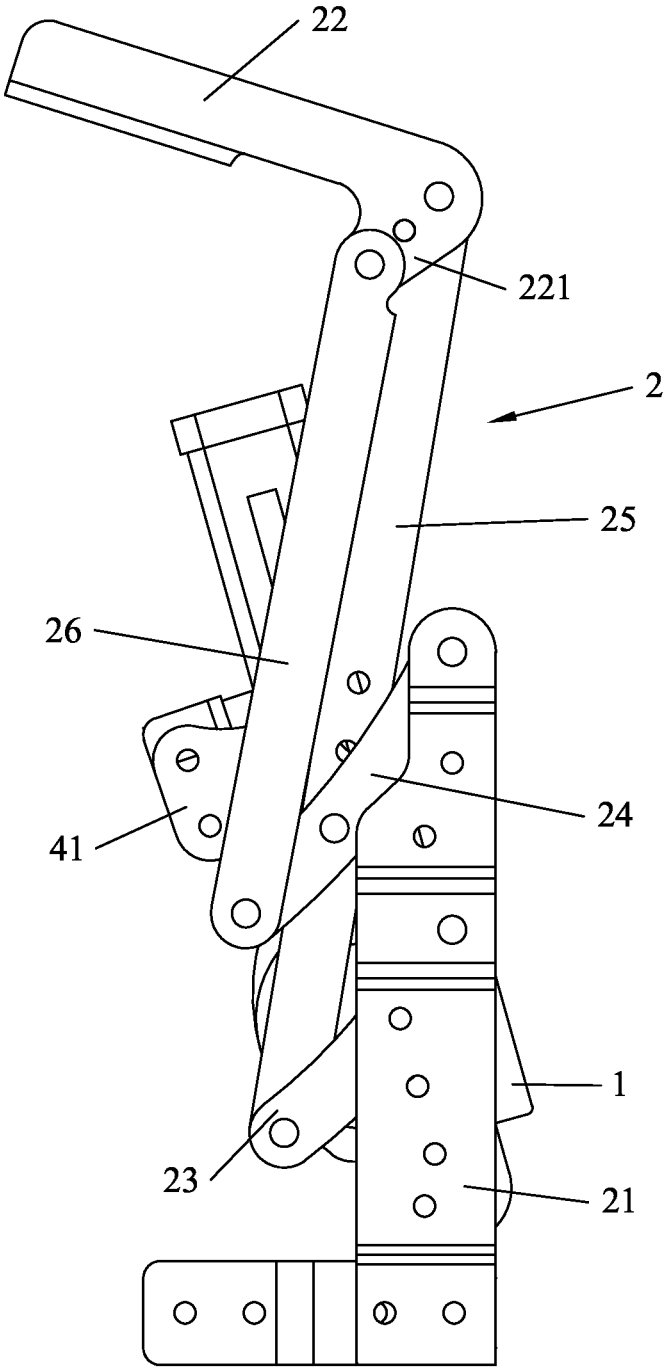
FIG. 3 is a side vies of the lifting stand according to one embodiment of the present invention.

As illustrated in FIGS. 1-4, the lifting stand according to the present invention is for mounting in a sofa body and a sofa headrest to automatically adjusting the using positions of the headrest, namely the tilting angle of the headrest relatively to the sofa body.

As an embodiment, the lifting stand includes a linear drive device 1 and two connecting link assemblies 2, the connecting link assemblies 2 are connected together via a fixed pole 3 and a driving pole 4, and the linear drive device 1 is configured between the two connecting link assemblies 2.

Each connecting link assembly 2 includes a first fastener 21, a second fastener 22, a first connecting link 23, a second connecting link 24, a third connecting link 25, and a fourth connecting link 26, therein the third and the fourth connecting links 25, 26 are linear linking members, and the first and the second connecting links 23, 24 are bended arc linking members. The first fastener 21 is fixed to the sofa body (not shown), and the second fastener 21 is fixed to the headrest (not shown).

Specifically, the first fastener 21 is vertical when installing in the sofa. One end of the first connecting link 23 and one end of the second connecting link 24 are pivotally connected to the same surface of the first fastener 21 respectively and extended towards the same side of the first fastener 21, and the first and the second connecting links 23, 24 are arranged on the first fastener 21 at a certain interval. Specifically, the second connecting link 24 is pivotally connected to the upper end of the first fastener 21 with the pivot (not labeled) is above the pivot connected between the first connecting link 23 and the first fastener 21. The other end of the first connecting link 23 is pivotally connected to one end of the third connecting link 25, the other end of the third connecting link 25 is pivotally connected to the second fastener 22, the other end of the second connecting link 24 is pivotally connected to one end of the fourth connecting link 26, the other end of the fourth connecting link 26 is pivotally connected to the second fastener 22 and arranged at intervals with the other end of the third connecting link 25. Specifically, the end of the second fastener 22 where the third connecting link 25 is connected is provided with a connecting portion 221 that is bended towards the other end of the second fastener 22, and the fourth connecting link 26 is pivotally connected to the connecting portion 221. Thus the distance from the pivot between the second fastener 22 and the fourth connecting link 226 to the other end of the second fastener 22 is shorter than that from the pivot between the second fastener 22 and the third connecting link 25 to the other end of the second fastener 22. The second connecting link 24 and the third connecting link 25 are pivotally connected together with a pivot configured between the two ends of the second connecting link 24 and between the two ends of the third connecting link 25 as well. It can be seen from the figures, both the first and the second connecting links 23, 24 of arc linkage member have an upward bending direction. The linkage members and fasteners mentioned above are connected via connecting means such as rivets to achieve the pivotal connection, and all pivoting axis are configured in parallel. Based on the relationship of the members mentioned above, the four links can be folded or unfolded relative to the first fastener 21.

As shown, each end of the fixed pole 3 is provided with a base 31, a straight metal piece 32 and a bended metal piece 33 to connect together. Specifically, the base 31 is fixed on the end of the fixed pole 3, the straight metal piece 32 is fixed on the outside of the base 31 and extended toward the first and the second connecting links 23, 24, the bended metal piece 33 is bended at its middle portion to make its two ends be not in the same plate but in parallel. The straight metal piece 32 is fixed on the front end of the bended metal piece 33, and the back end of the bended metal piece 33 is fixed on the lower end of the first fastener 21. As such, the fixed pole 3 is connected and fixed between the two connecting link assemblies 2, that is, between two second fasteners 22 for more specifically.

In the present embodiment, the driving pole 4 is located above the fixed pole 3, and its two ends are connected with the third connecting links 25 of the two connecting link assemblies 2. Specifically, the two ends of the driving pole 4 is connected with a connecting piece 41 one end of which is fixed on the driving pole 4 and other end of which is fixed on the third connecting link 25. By arranging the connecting piece 41, the moment applied to the third connecting link 25 can be increased, thereby facilitating to actuate the third connecting link 25.

The lower end of the linear drive device 1 is pivotally connected to the middle position of the fixed pole 3 and connected with the first fattener 21 via the fixed pole 3, the base 31, the straight metal piece 32 and the bended metal piece 33. The upper end of the linear drive device 1 has an output end that is capable of sliding linearly, specifically can slide upwardly to protrude or slide downwardly to retract. And the upper end of the linear drive device 1 is tilted to a side where the first sand the second connecting links 23, 24 is extended, that is, the sliding direction of the output end 11 is tilted relatively to the vertical direction. As shown, two pivoting arms 42 are protruded and formed on the driving pole 4, and the two pivoting arms 42 are positioned at two sides of the output end 11 and pivotally connected to the output end 11. As such, the driving pole 4 can be actuated and moved up or down by the output end 11, also, the driving pole 4 can be pivoted relative to the output end 11, and the output end 11 is connected with the third connecting link 25 via the driving pole 4. When the output end 11 is drawn back, the third and the fourth connecting links 25, 26 can be folded relatively to the first fastener 21; when the output end 11 is protruded, the third and fourth connecting links 25, 26 can be unfolded relatively to the first fastener 21. As an embodiment, the linear driving device 1 can be a linear motor, and the output end 11 can be a slider.

Figure 4:
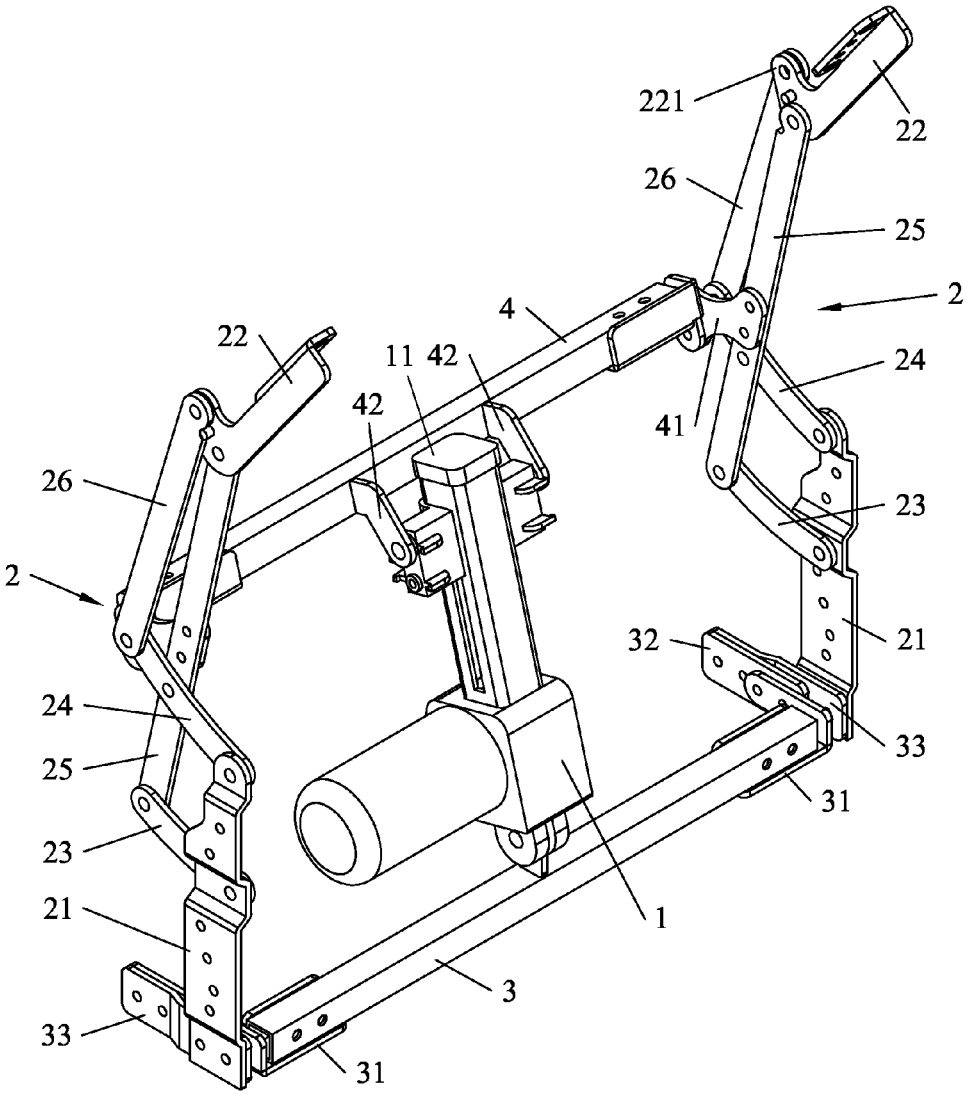
FIG. 4 is a perspective view of a lifting stand after adjusting position according to one embodiment of the present invention.

By combination with the FIGS. 1 and 4, if the lifting stand is in a position of FIG. 1 and to be adjusted the position, firstly the linear drive device 1 is started so that the output end 11 is slid upwardly to push the driving pole 4 to move upwardly, which causes the third connecting link 25 move in the same manner as the ends of the driving pole 4 is fixed on the third connecting link 25. Synchronously the third connecting link 25 is pivoted thereby causing the second connecting link 24 to pivot about the upper pivot on the first fastener 21, subsequently the end of the second connecting link 24 far-from the first fastener 21 is moved upwardly to push the fourth connecting link 26 to move upwardly. By combination with the actuations of the third and the fourth connecting links 25, 26, the second fastener 22 is turned over backwards, which changes the angle between the headrest that is connected with the second fastener 22 and the sofa body, thereby achieving the angle or position adjustment. At this moment, the linear drive device is stopped so as to lock the headrest to stay in the instant position, as shown in FIG. 4.

In comparison with the prior art, the lifting stand of the present invention adjusts the angle of the headrest by the protruding and the retracting operations of the output end 11 of the linear drive device 1. The adjustment process is implemented automatically as long as the linear drive device 1 is started and then stopped in a certain position, without manual operation to turn the headrest. Furthermore, because of the compact pivotal connections among the connecting link assemblies 2, the lifting stand will not expose on the connection position between the sofa body and the headrest, which keeps a nice appearance for the sofa.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A lifting stand for an adjusting headrest, comprising a linear drive device and at least one connecting link assembly, the connecting link assembly comprising a first fastener, a second fastener, a first connecting link, a second connecting link, a third connecting link, and a fourth connecting link;

wherein a first end of the first connecting link and a first end of the second connecting link are pivotally connected to the first fastener respectively and arranged at an interval, a second end of the first connecting link is pivotally connected to a first end of the third connecting link, a second end of the third connecting link is pivotally connected to the second fastener, a second end of the second connecting link is pivotally connected to a first end of the fourth connecting link, a second end of the fourth connecting link is pivotally connected to the second fastener and arranged at a second interval with the second end of the third connecting link, the second connecting link and the third connecting link are pivotally connected together with a pivot configured between the first and the second ends of the second connecting link and between the first and the second ends of the third connecting link as well;

the linear drive device having an output end that is capable of linearly sliding is connected to the first fastener, with the output end connected to the third connecting link; the third connecting link and the fourth connecting link are folded relatively to the first fastener when the output end is drawn back, and the third connecting link and the fourth connecting link are unfolded relatively to the first fastener when the output end is protruded;

wherein the first fastener is configured vertically, the first and the second connecting links are extended towards the same side of the first fastener, the second connecting link is pivotally connected to an upper end of the first fastener, a pivot between the first fastener and the first connecting link is configured below a pivot between the first fastener and the second connecting link, the third connecting link is pivotally connected to a first end of the second fastener, and a distance from a pivot between the second fastener and the fourth connecting link to a second end of the second fastener is shorter than that from a pivot between the second fastener and the third connecting link to the second end of the second fastener;

wherein the first end of the second fastener where the third connecting link is connected is provided with a connecting portion that is bent towards the second end of the second fastener, and the fourth connecting link is pivotally connected to the connecting portion.

2. The lifting stand for an adjusting headrest according to claim 1, wherein the linear drive device has a lower end connected to the first fastener, and an upper end tilted to a side where the first and the second connecting links are extended, and the output end has a sliding direction tilted relatively to a vertical direction.

3. The lifting stand for an adjusting headrest according to claim 1, wherein the third and the fourth connecting links are linear linking members, and the first and the second connecting links are bent arc linking members.

4. The lifting stand for an adjusting headrest according to claim 1, wherein two connecting link assemblies are included, and the linear drive device is configured between the two connecting link assemblies.

5. The lifting stand for an adjusting headrest according to claim 1, further comprising a fixed pole and a driving pole, wherein two ends of the fixed pole are fixed on the first fasteners of the two connecting link assemblies respectively, two ends of the driving pole are fixed on the third connecting links of the two connecting link assemblies respectively, the linear drive device is pivotally connected to the fixed pole, and the output end thereof is pivotally connected to the driving pole.

6. The lifting stand for an adjusting headrest according to claim 1, wherein two pivoting arms are protruded and formed on the driving pole, which are positioned at two sides of the output end and pivotally connected to the output end.

7. The lifting stand for an adjusting headrest according to claim 1, wherein a connecting piece is formed on two ends of the driving pole respectively, and the connecting piece has one end fixed on the driving pole and another end fixed on the third connecting link.

8. The lifting stand for an adjusting headrest according to claim 1, wherein the linear drive device comprises a linear motor.

9. A lifting stand for an adjusting headrest, comprising a linear drive device and at least one connecting link assembly, the connecting link assembly comprising a first fastener, a second fastener, a first connecting link, a second connecting link, a third connecting link, and a fourth connecting link;

wherein a first end of the first connecting link and a first end of the second connecting link are pivotally connected to the first fastener respectively and arranged at an interval, a second end of the first connecting link is pivotally connected to a first end of the third connecting link, a second end of the third connecting link is pivotally connected to the second fastener, a second end of the second connecting link is pivotally connected to a first end of the fourth connecting link, a second end of the fourth connecting link is pivotally connected to the second fastener and arranged at a second interval with the second end of the third connecting link, the second connecting link and the third connecting link are pivotally connected together with a pivot configured between the first and the second ends of the second connecting link and between the first and the second ends of the third connecting link as well;

the linear drive device having an output end that is capable of linearly sliding is connected to the first fastener, with the output end connected to the third connecting link; the third connecting link and the fourth connecting link are folded relatively to the first fastener when the output end is drawn back, and the third connecting link and the fourth connecting link are unfolded relatively to the first fastener when the output end is protruded;

wherein two connecting link assemblies are included, and the linear drive device is configured between the two connecting link assemblies; and a fixed pole and a driving pole are included, wherein two ends of the fixed pole are fixed on the first fasteners of the two connecting link assemblies respectively, two ends of the driving pole are fixed on the third connecting links of the two connecting link assemblies respectively, the linear drive device is pivotally connected to the fixed pole, and the output end thereof is pivotally connected to the driving pole; wherein two pivoting arms are protruded and formed on the driving pole, which are positioned at two sides of the output end and pivotally connected to the output end.

10. A lifting stand for an adjusting headrest, comprising a linear drive device and at least one connecting link assembly, the connecting link assembly comprising a first fastener, a second fastener, a first connecting link, a second connecting link, a third connecting link, and a fourth connecting link;

wherein a first end of the first connecting link and a first end of the second connecting link are pivotally connected to the first fastener respectively and arranged at an interval, a second end of the first connecting link is pivotally connected to a first end of the third connecting link, a second end of the third connecting link is pivotally connected to the second fastener, a second end of the second connecting link is pivotally connected to a first end of the fourth connecting link, a second end of the fourth connecting link is pivotally connected to the second fastener and arranged at a second interval with the second end of the third connecting link, the second connecting link and the third connecting link are pivotally connected together with a pivot configured between the first and the second ends of the second connecting link and between the first and the second ends of the third connecting link as well;

the linear drive device having an output end that is capable of linearly sliding is connected to the first fastener, with the output end connected to the third connecting link; the third connecting link and the fourth connecting link are folded relatively to the first fastener while the output end is drawn back, and the third connecting link and the fourth connecting link are unfolded relatively to the first fastener while the output end is protruded;

wherein two connecting link assemblies are included, and the linear drive device is configured between the two connecting link assemblies; and a fixed pole and a driving pole are included, wherein two ends of the fixed pole are fixed on the first fasteners of the two connecting link assemblies respectively, two ends of the driving pole are fixed on the third connecting links of the two connecting link assemblies respectively, the linear drive device is pivotally connected to the fixed pole, and the output end thereof is pivotally connected to the driving pole; wherein a connecting piece is formed on two ends of the driving pole respectively, and the connecting piece has one end fixed on the driving pole and another end fixed on the third connecting link.

* * * * *